US006635813B2

(12) United States Patent
Campling

(10) Patent No.: US 6,635,813 B2
(45) Date of Patent: Oct. 21, 2003

(54) CAPO

(75) Inventor: Nicholas John Campling, 95 Dunsberry, Bretton, Peterborough, Cambridgeshire PE3 8LB (GB)

(73) Assignees: Nicholas John Campling, Peterborough (GB); John Brian Richard Lewis, Peterborough (GB)

( * ) Notice: Subject to any disclaimer, the term of this patent is extended or adjusted under 35 U.S.C. 154(b) by 0 days.

(21) Appl. No.: 09/822,577

(22) Filed: Mar. 30, 2001

(65) Prior Publication Data

US 2001/0027711 A1 Oct. 11, 2001

(30) Foreign Application Priority Data

Apr. 6, 2000 (GB) ..... 0008362

(51) Int. Cl.[7] ..... G10D 3/00
(52) U.S. Cl. ..... 84/318
(58) Field of Search ..... 84/318, 315, 316, 84/317; 81/314, 315, 316, 317–325

(56) References Cited

U.S. PATENT DOCUMENTS 4,143,576 A * 3/1979 Nichols et al. ..... 84/318
4,149,443 A 4/1979 Bringe
4,250,790 A * 2/1981 Shubb et al. ..... 84/318
4,270,432 A 6/1981 Wilkerson
4,324,165 A 4/1982 Wilkerson
4,583,440 A 4/1986 Powell, Jr.
5,431,080 A * 7/1995 Wiesenthal ..... 84/318
5,492,045 A * 2/1996 Roblee ..... 84/318
5,623,110 A * 4/1997 Hoglund et al. ..... 84/318
5,792,969 A * 8/1998 Shubb et al. ..... 84/318
6,008,441 A 12/1999 Steinberger
6,459,025 B1 * 10/2002 D'Addario ..... 84/318

* cited by examiner

*Primary Examiner*—Kimberly Lockett
(74) *Attorney, Agent, or Firm*—Brooks & Kushman P.C.

(57) ABSTRACT

A capo (10) for use with a stringed instrument having a plurality of strings (4) and a neck (2). The neck (2) comprising a fingerboard (6) and a back (8). The capo (10) comprising a string engaging arm (12) and a clamping arm (14) that are adapted to press against and clamp the strings (4). The arms (12,14) pivotally interconnected about a pivotal connection (16) and axis (1) at a position along said arms (12,14) that is adjacent a side of the neck (2). The pivotal connection includes a releasable locking means (18) which is operable to selectively lock and unlock the pivotal connection and the relative pivotal movement of the clamping arm (14) and string engaging arm (12) at least in a particular direction.

11 Claims, 6 Drawing Sheets

CAPO

The present invention relates to a capo for a stringed instrument, in particular a guitar, banjo or similar such instrument.

A capo, sometimes variously termed a capodastro, capodaster, capo tasto or cedilla, is a device well-known and used by players of stringed instruments and in particular guitar and banjo players. A capo can be used with a stringed instrument, for example a guitar or banjo, which has a neck and a set of strings extending along the length of the neck. The neck comprises a fingerboard portion adjacent to the strings and a back. The fingerboard includes a number of fret bars which protrude slightly from the fingerboard/neck surface and extend laterally across the neck. The capo, when applied, serves to hold the strings against the fingerboard provided along the neck, and in particular against one of the number of fret bars disposed along the length of the fingerboard and which extend from the fingerboard, to reduce the effective length of the strings and therefore adjust the pitch produced by the strings.

When a capo is in use on an instrument neck a string engaging portion or arm of the capo is arranged to press the strings against the surface of the fingerboard to sandwich the strings against the fret bars and/or fingerboard. In order to press the string engaging portion against the fingerboard the capo is required, and includes: suitable means for it, to be clamped to the neck. In a number of previous capo designs the clamping of the capo to the neck has been provided through the use of relatively cumbersome clamping mechanisms utilising screw mechanism, toggle levers and other means which are difficult to handle and/or time consuming to attach. In particular, the constructions of previous capos have generally been such that the acts of attaching one to an instrument neck, removing it, or moving its position have undesirably required the use of two hands.

With prior designs of capo including levers or screw mechanisms to apply the clamping load a degree of mechanical advantage is used to apply the clamping load and press the capo against the strings and towards the fingerboard. Whilst the use of such mechanical advantage makes applying sufficient clamping force easier it can cause problems. In particular with such arrangements, due to the mechanical advantage, it is relatively easy to, unintentionally and accidentally, apply too great a clamping force. This can lead to overstressing of the strings, especially when the capo is used close to a fret bar on the instrument, which can damage the strings, alter the tuning and/or in the extreme damage the instrument neck. The clamping force and pressure applied with such capos can also not be directly sensed or felt by the player. The player therefore loses a degree of 'feel' which, as would be understood, is undesirable. A yet further problem with some of these designs is that the clamping arrangements tend, to some extent, to be specific or require substantial adjustment, to particular instruments and the profile and sizes of neck of the instrument. It is therefore often difficult, time consuming, and cumbersome for such capos to be used on different instruments, different sized necks and/or on a single instrument which has a neck having a cross section which varies substantially along its length.

There are numerous examples of such capo designs including such clamping mechanisms. In particular examples of such designs are proposed and described in the following patents: U.S. Pat. Nos. 5,492,045; 4,149,443; and 5,792,969.

In other prior capo designs spring mechanisms (generally torsion springs) are used to provide the clamping force.

Examples of such capos are described in U.S. Pat. Nos. 4,143,576 and 4,583,440. With these designs the string engaging arm is pivotally attached at one end to a clamping arm. In use the capo is fitted to the instrument neck with the string engaging arm abutting against the strings and press the strings toward the fingerboard whilst the clamping arm abuts and bears against the opposite rear surface of the neck. A torsion spring is provided within the pivotal mounting to urge the two arms together, with the strings and neck of the instrument sandwiched therebetween, and provide the clamping force.

As described in the prior patents such capo designs are easier and quicker to apply and can be fitted by the player one handed. There is however still the real possibility that the capo may overstress the strings and/or instrument since the torsion spring may be too strong for a particular instrument or position on the instrument neck. The clamping force provided by the spring will also vary depending upon how wide the arms are opened in order to accommodate the neck and consequently the clamping force may vary when the capo is used on different sizes of instrument necks. Furthermore with such capos the player has no control over the clamping force applied, with the clamping force being determined by the stiffness of the spring. Such lack of control over the clamping force and pressure applied is clearly undesirable for the musician. In addition if the spring is too stiff for a particular instrument then over stressing can occur. The position of the capo arms is also not locked or secured, with the capo simply relying on the resilience of the spring to hold it in place.

It is therefore desirable to provide an improved capo which addresses the above described problems by providing a capo which is simple and easy to apply and which will not overstress the strings or neck of the instrument and/or which offers improvements generally.

According to the present invention there is provided a capo as described in the accompanying claims.

In an embodiment of the invention there is provided a capo for use with a stringed instrument having a plurality of strings and a neck. The neck comprises a fingerboard and a back. The capo comprises a string engaging arm, a clamping arm and a pivotal connection to pivotally interconnect the two arms. The string engaging arm is adapted to extend across the fingerboard above the strings and in use press against the strings. The clamping arm is adapted, in use, to extend across and engage the back of the neck. The pivotal connection pivotally interconnects the clamping arm to the string engaging arm at a position along said arms that is arranged, in use, to be adjacent said neck such that the arms can be pivoted relative to each other in order to, in use, fit and clamp the strings and neck between said arms. Preferably the pivotal connection is disposed, in use, generally towards one side of the neck. The pivotal connection includes a releasable locking means which is operable to selectively lock and unlock the pivotal connection and the relative pivotal movement of the clamping arm and string engaging arm at least in a particular direction.

Such a capo of this embodiment of the invention addresses the above described problems with the locking mechanism providing a means for locking the position of the arms and the capo in the position set by the player. The clamping force applied by the capo can therefore be set by the player applying the required force to close the capo on the neck of the instrument with this clamping force then being maintained by the locking means which prevents the arms and capo from opening.

Preferably the locking means is operable to selectively lock and unlock the pivotal connection and relative pivotal movement of the clamping arm and string engaging arm away from each other and the neck of the instrument and so prevent opening of the capo when locked. Furthermore the releasable locking means may advantageously be biassed so that the pivotal connection is normally locked to prevent opening of the capo.

In this way the capo can then be closed on the neck and the required clamping force applied with the locking means already engaged. There is therefore no need to separately actuate the locking means as the required clamping force is applied so making the fitting of the capo even easier.

The present invention will now be described by way of example only with reference to the following figures in which:

in FIG. 7, and FIG. 9 being an exploded view of the capo of FIGS. 7 and 8.

Figure 1:
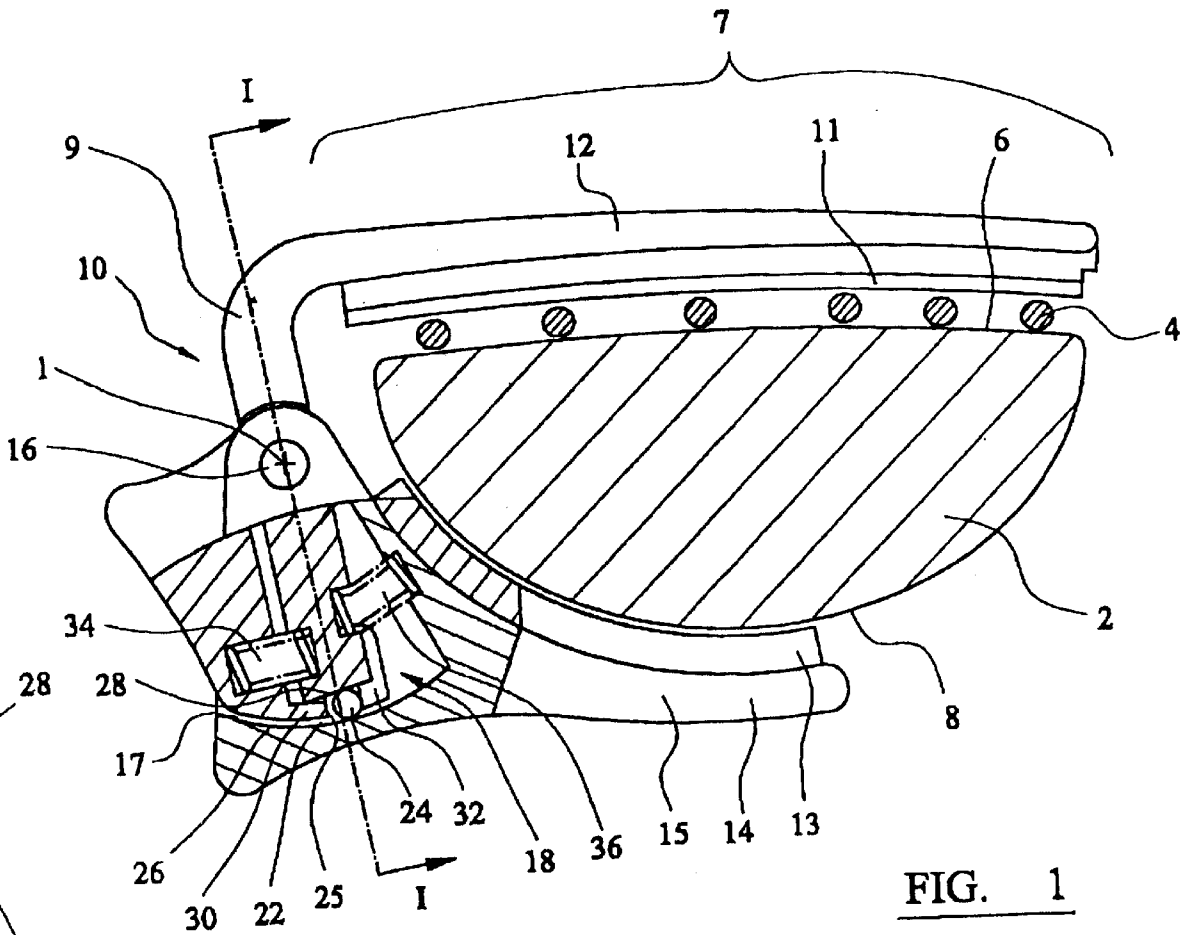
FIG. 1 is a part sectioned side elevation of a capo according to the present invention installed on the neck of a stringed instrument.
Figure 2:
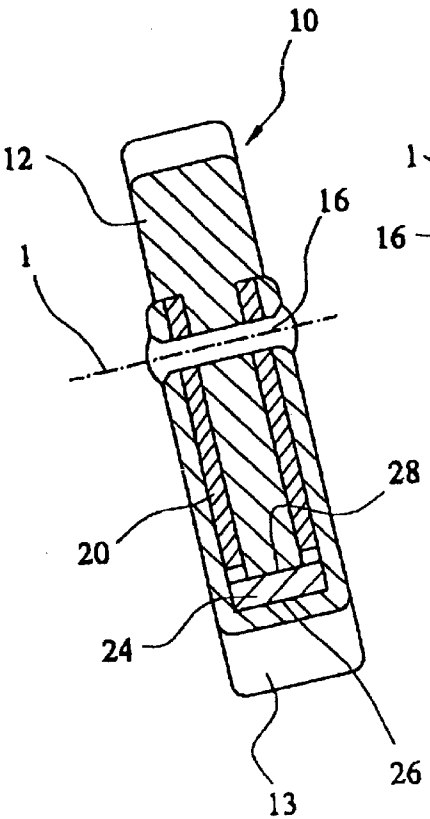
FIG. 2 is a sectional view along plane I of the capo shown in FIG. 1.
Figure 3:
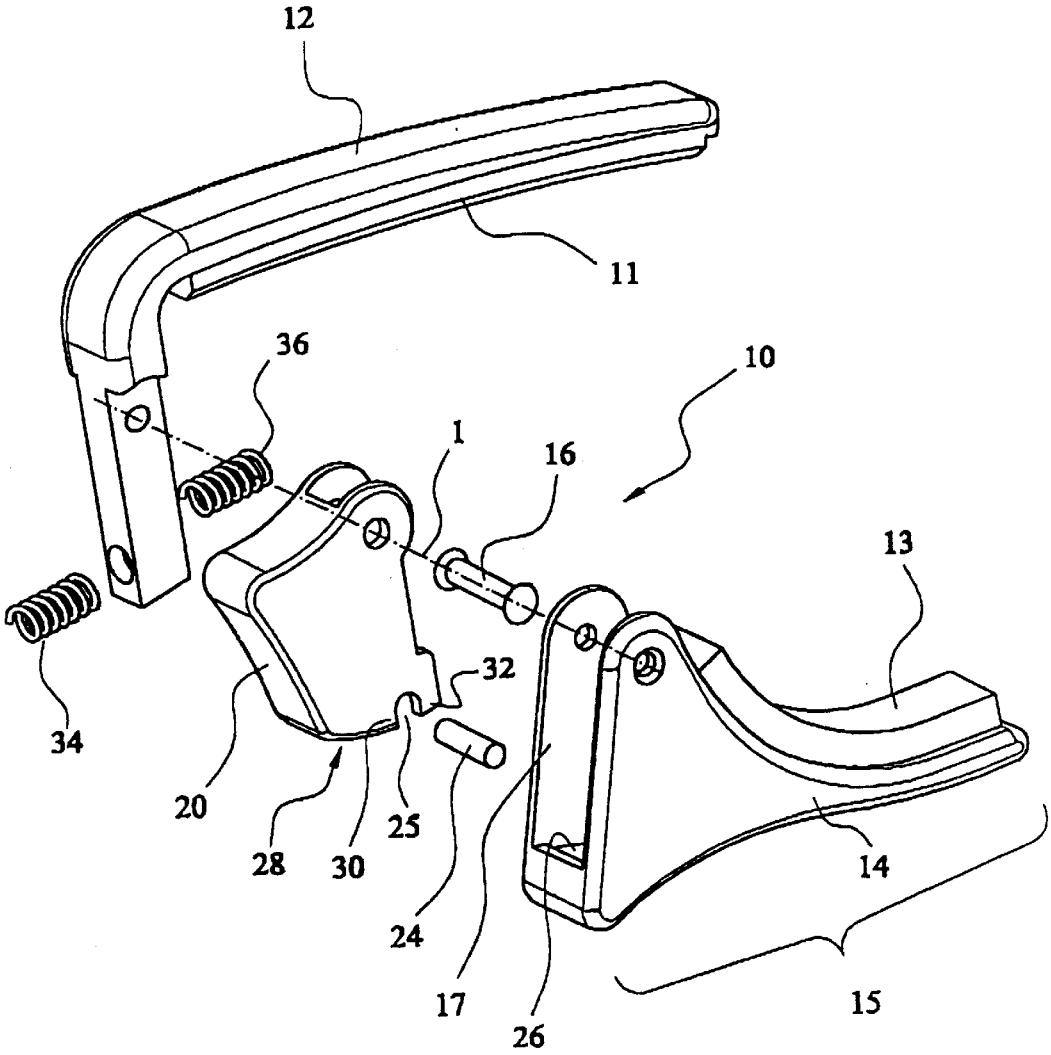
FIG. 3 is an exploded perspective illustration of the capo shown in FIGS. 1 and 2.

A capo 10 according to a first embodiment of the present invention is shown in FIGS. 1 to 3. Referring to FIG. 1 the capo 10 is arranged to be applied to a stringed instrument which has a plurality of strings 4 which extend along the length of a neck 2 of the instrument with the strings 4 positioned adjacent to a fingerboard surface 6 of the neck 2. The fingerboard includes a number of fret bars which are disposed along the neck, extend laterally across the neck, and protrude slightly from the surface of the fingerboard 6. The capo 10 when installed is arranged to clamp the strings 4, and press the strings 4 towards the fingerboard 6 of the neck 2 with the strings 4 generally sandwiched between the capo 10 and the fingerboard surface 6 of the neck 2. Specifically the strings 4 are generally clamped against the fret bars of the fingerboard 6 by the capo 10.

The capo 10 comprises a generally L shaped string engaging arm 12. The arm 12 includes a main string engaging portion 7 which extends across the width of the neck 2 and which when the capo 10 is fitted to the neck 2 engages with the strings 4 to press the strings 4 towards and against the fingerboard 6 of the neck 2 and in particular against the fret bars of the fingerboard 6. A resilient layer 11 is provided on the lower surface main portion 7 of the string engaging arm 12, along a portion of the arm 12 which contacts with the strings 4. A minor portion 9 of the string engaging arm 12 extends generally perpendicular to the main portion 7 and when the capo 10 is fitted to the neck 2 of the instrument and is generally perpendicular to the fingerboard surface 6 and extends along and adjacent to one side of the neck 2.

A clamping arm 14 is pivotally attached via :pivot pin 16 to the string engaging arm 12. The clamping arm 14 is generally L shaped with one side of the arm 14 of an arcuate profile to co-operate with the general, typical shape of the neck 2 of the instruments on which the capo 10 is to be applied. The clamping arm 14 has a main portion 15 which, when the capo 10 is fitted to the neck 2, extends across the back of the neck 2 and abuts and bears against a back surface 8 of the neck 2 generally opposite to the fingerboard surface 6. As shown a resilient layer of material 13, to prevent damage to the neck 2, is provided on the portion of the claiming arm 14 that is arranged to abut against the neck 2 of the instrument. A minor portion 17 of the clamping arm 14 is generally perpendicular to the main portion 15 and is arranged to extend along and adjacent to the side of the neck 2. The pivot pin 16 which pivotally interconnects the string engaging arm 12 and clamping arm 14 is located towards one end of the arms 12,14, within the minor portions 9,17 of the arms 12,14 and at a position which when the capo 10 is fitted to the instrument, is generally adjacent to and/or towards one side of the neck 2. In use the arms 12,14 are pivoted about the pin 16 so that the neck 2 of the instrument is clamped between the arms 12,14 with the string engaging arm 12 pressing the strings 4 towards the fingerboard 6, and specifically against the fret bars of the fingerboard 6, whilst the clamping arm 14 abuts and presses against the back, opposite, surface 8 of the neck 2.

The capo 10 also includes a releasable locking mechanism generally indicated at 18, and a release lever 20 which is also pivotally mounted at one end about pivot pin 16. The locking mechanism 18 locks the pivotal connection and the relative pivotal movement of the clamping arm 14 and string engaging arm 12 such that when locked, relative movement of the two arms 12,14, at least in one direction (in this case in the opening direction) is prevented or restricted. By operating the release lever 20 the locking mechanism 18 is unlocked to allow the arms 12,14 to pivot about the pivot pin 16 and pivotal connection, allowing the arms 12,14 to pivot and move relative to each other, and in this case for the arms 12,14 to move apart and the capo 10 open.

The locking mechanism 18 comprises a wedge member in the form of a small roller 24 which is located and engagable within a tapered recess or clearance (indicated generally at 22). The tapered recess 22 is defined between and, by, a flat angled end surface 28 of the minor portion 9 of the string engaging arm 12 and an opposite facing cooperating arcuate profiled surface 26 within the clamping arm 14. The profile of the opposite facing arcuate surface 26 within the clamping arm 14 is centered about the center of the pivot pin 16. The angled end surface 28 of the string engaging arm 12 is angled so as to produce the tapered recess or gap 22 between the two surfaces 26,28 which tapers and narrows towards the left as shown in FIG. 1. Consequently the dimension of the recess 22 between the two surfaces 26,28 is at one end (the right hand end as shown in FIG. 1) slightly greater than the diameter of the roller 24 whilst at the narrow end (the left hand end in FIG. 1) it is slightly smaller than the diameter of the roller 24. By virtue of the tapering of the recess 22, pivoting the arms 12,14 such that they are moved away from each other and the capo 10 is opened up causes the roller 24 to become entrained and moved towards the narrower end so becoming engaged and jammed within the recess 22. This locks the arms 12,14 and restricts the pivoting of the arms 12, 14. However pivoting the arms in the other direction i.e. closing the capo 10 and moving them towards each other in a clamping direction, will tend to urge the roller 24 towards the wider end of the recess 22. This releases the roller 24 from locking engagement with the recess surfaces 26,28 and accordingly the arms 12, 14 can be pivoted and moved in this direction.

The release lever 20 includes two projections 30,32 that define a slot 25 with which the ends of the roller 24 are loosely retained. A small spring 34 is disposed between the release lever 20 and minor portion 9 of the string engaging arm 12 and is biassed to pivot the end of the release lever 20 so that the roller 24 is urged into the recess 22, towards the narrow end, by the projection 32. This assists in locking the arms 12,14 and ensures that the locking mechanism 18 is automatically biassed into the locked position.

To unlock the arms 12,14 allowing the capo 10 to be opened and the arms 12,14 moved apart the release lever 20 is operated and moved such that the projection 30 towards the narrow end of the recess 22 moves the roller 24 towards the wider end of the recess 22. The roller 24 is then disengaged from the recess 22 surfaces 26,28 and the jamming action released allowing the arms 12,14 be moved apart and the capo 10 opened.

A light spring 36 is provided between the string engaging arm 12 and clamping arm 14. This spring 36 is arranged to urge the arms 12,14 to pivot towards each other, and accordingly to close the capo 10 and/or clamp the neck 2 of the instrument. It should be appreciated however that the spring 36 is preferably a very light spring and it only very gently forces the arms 12,14 together. The spring 36 typically does not provide a sufficient clamping force in order to apply the capo 10. Indeed in other embodiments this biassing spring 36 may be omitted. Alternatively the light spring 36 may be arranged to urge the arms 12,14 to pivot apart and accordingly open the capo 10. In this way removal and opening of the capo 10 from the neck 2 is made easier. Such movement however only occurring once the capo 10 and locking means 18 is unlocked.

In operation the capo 10 is opened by pressing the release lever 20 which allows the arms 12,14 to pivot and also since, the lever 20 is arranged to bear against a part of the string engaging arm 12, it moves the arms 12,14 apart. The capo 10 is then positioned so that the arms 12,14 enclose the neck 2 of the instrument and the release lever 20 is released. The capo 10 is then closed on the neck 2 and the arms 12,14 moved towards each other, the locking mechanism 18 allowing such movement in this direction. This is assisted by the light spring 36 which, if fitted, will bias the arms 12,14 towards the closed position. The clamping pressure to locate the capo 10 on the neck 2 and to clamp the strings 4 against the fingerboard surface 6 is applied by the player squeezing the arms 12,14 together. In this way the player determines the clamping pressure and determines the level of pressure applied. The locking mechanism 18, which is automatically engaged, inhibits the capo 10 opening up after this has been applied and maintains the arms 12,14 in the clamped, closed position maintaining the clamping force that has been applied. To remove the capo 10 the release lever 20 is pressed, which releases the locking mechanism 18 allowing the arms 12,14 to be pivoted apart and the capo 10 to be opened and removed from the neck 2. The capo can also be easily and conveniently released and partially opened and then slid along the neck 2 to a different position along the neck 2.

It should be noted from the above description that the capo 10 be very simply and easily applied. In particular the capo 10 can, if required, be applied using one hand with the locking mechanism 18 automatically being engaged to ensure that the arms 12,14 are locked in the correct applied position with the required clamping force.

Two further exemplary embodiments of the present invention are shown in FIGS. 4 to 9. These are generally similar to the first embodiment described above and like reference numerals have been used for like items. In particular both of these further embodiments include a string engaging arm 12 which is pivotally connected to a clamping arm 14 with the pivot arranged towards an end of the arms 12,14 and arranged to be located in use adjacent to one side of the neck 2 of the instrument. The embodiments also including locking mechanism 18 to lock pivotal movement of the arms 12,14 and a release lever 50,62 which is operable to unlock the locking mechanism 18. These embodiments are also applied in generally the same way as the first embodiment. The main significant difference between these embodiments is in the detail of the locking mechanisms 18 and the pivot arrangement of the arms 12,14 in order to accommodate these different locking mechanisms 18.

Figure 5:
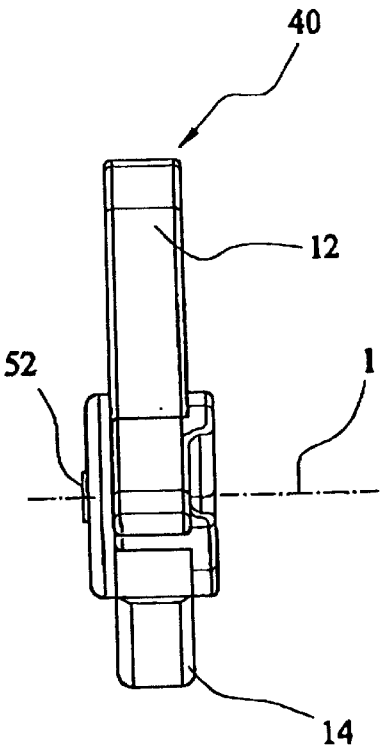
FIGS. 4 to 6 show a capo according to a second embodiment of the present invention, with FIG. 4 being a part sectioned side elevation of the capo, FIG. 5 being an end view on arrow II of the capo of FIG. 4, and FIG. 6 being an exploded view of the capo of FIGS. 4 and 5.
Figure 4:
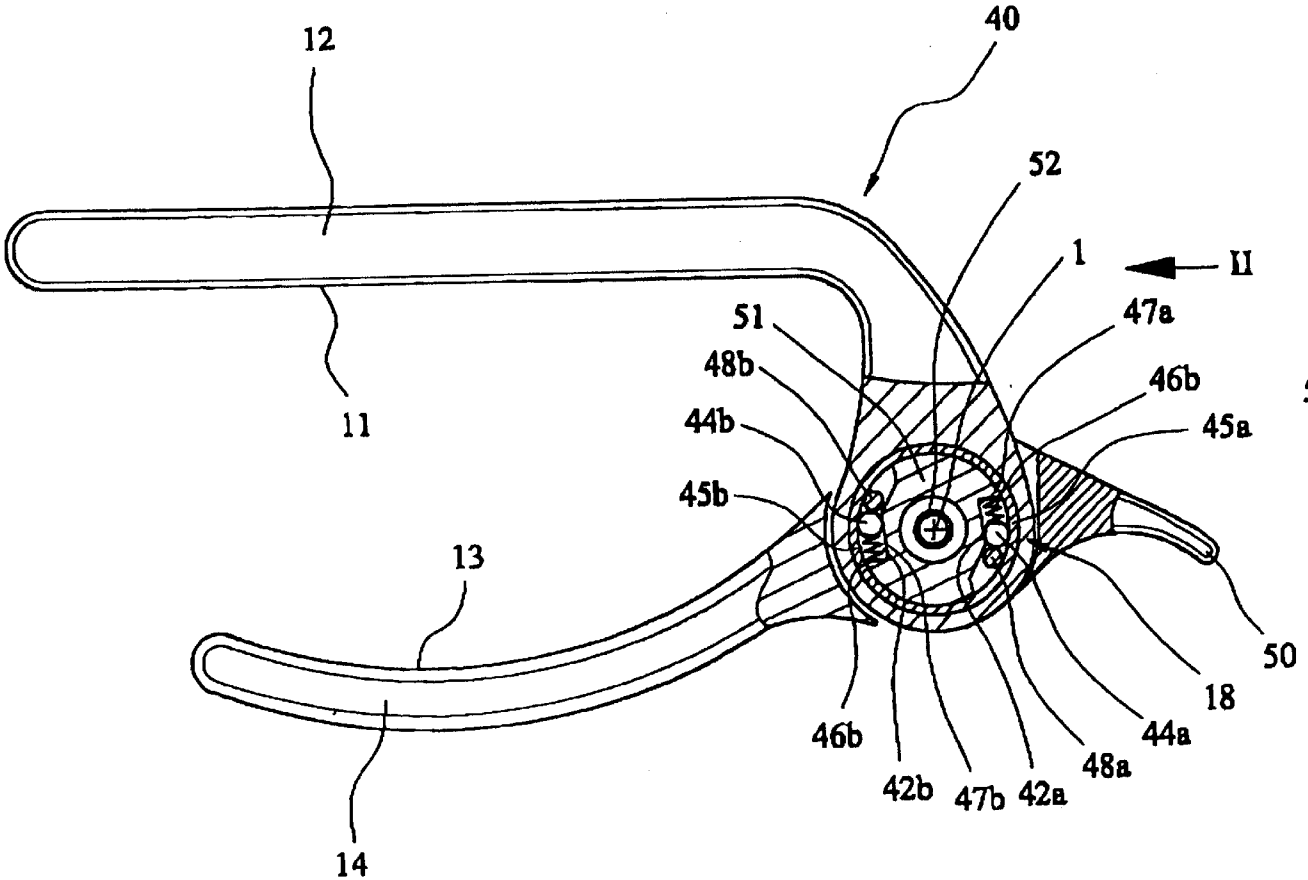
Figure 6:
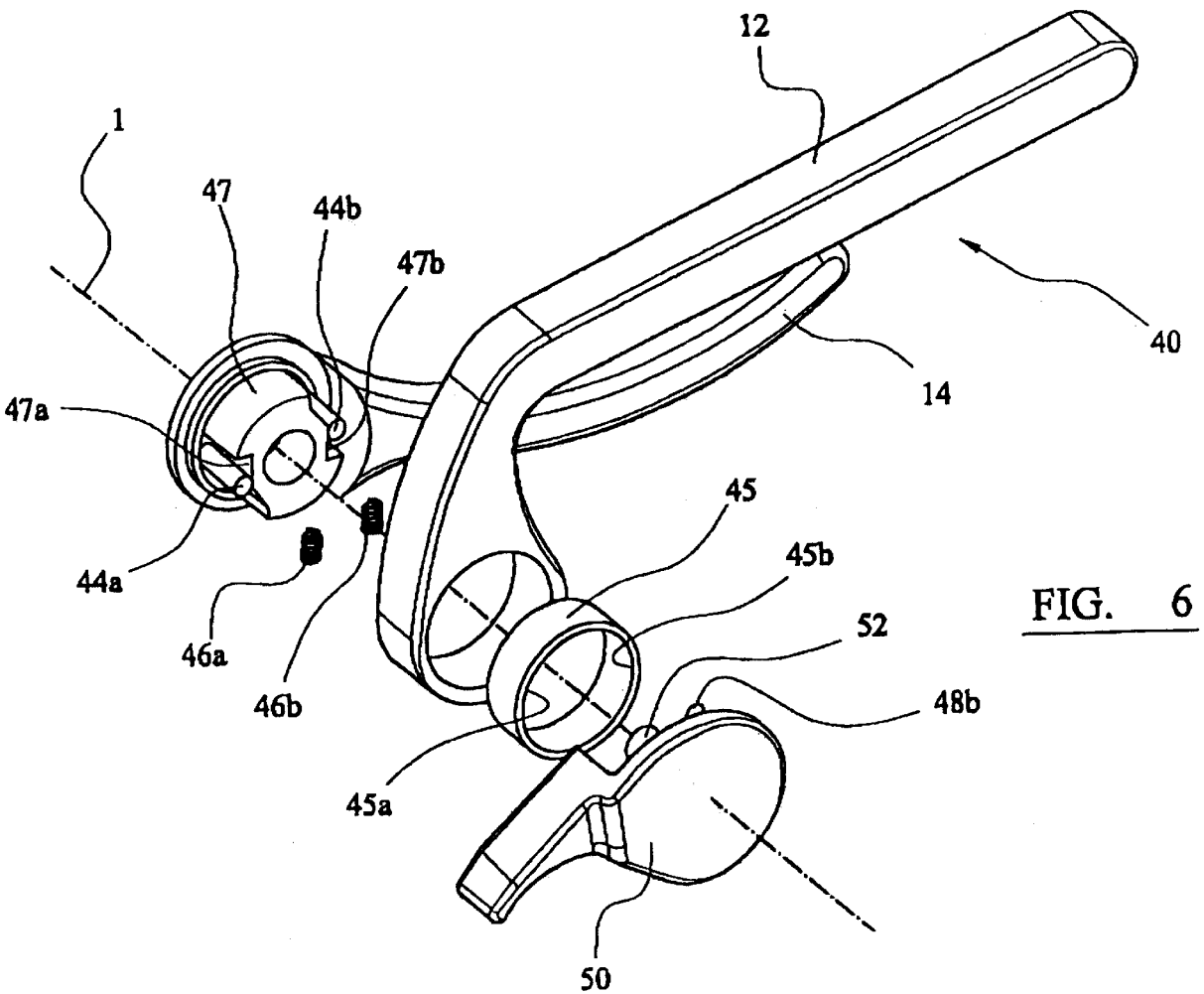

In the embodiment shown in FIGS. 4 to 6 the capo 40 includes arms 12,14 which pivot about a rotary locking mechanism 51. The mechanism 18 comprises an outer ring member 45 which is located within and attached to the string engaging arm 12. The outer ring member 45 may however alternatively be integral with the string engaging arm 12. A spigot 47 extending from the clamping arm 14 is located within the ring 45 and the two arms 12,14 are thereby pivotally connected. Part of the spigot 47 is cutaway such that a tapered chamber 42*a*,42*b* is defined between a surface 45*a,b* of the ring 45 and the cut out surface 47*a,b* of the spigot 47. A roller 44*a,b* is located within the tapered recess 42*a,b* with the diameter of the roller 44*a*,44*b* slightly greater than the narrow end of the tapered recess 42*a,b* and slightly smaller than the wider end of the recess 42*a,b*. A small spring 46*a*,46*b* is also located within the recess 42*a*,42*b* and is arranged to urge and bias the roller 44*a,b* towards the narrow end of the recess 42*a*,42*b* and into engagement with the recess 42*a*,42*b* defining surfaces 45*a*,47*a*, & 45*b*,47*b*. The roller 42*a*,42*b* thereby acts like a wedge and becomes jammed within the recess 42*a*,42*b*. Accordingly the movement of the arms 12,14 is restricted and by virtue of the taper direction the arms 12,14 are prevented and locked from being opened.

A release lever 50 is also pivotally mounted about the pivot axis 1 and includes a spigot 52 which defines the central pivot of the capo 40. Two projections from the release lever 50 extend into the recesses 42*a*,42*b* in a position proximate to the roller 44*a*,44*b*. The projections 48*a,b* are arranged such that when the release lever 50 is moved the projections 48*a,b* urge the rollers 44*a,b* out of engagement with the recesses 42*a*,42*b* and recess surfaces 45*a*,47*a* and 45*b*,47*b*, against the bias springs 46*a*,46*b*, so unlocking the mechanism 18 and permitting the arms 12,14 to move.

Although the locking mechanism 18 shown in this embodiment comprises a pair of recesses 42*a,b* and rollers 44*a,b* it will be appreciated that any number could be used in other embodiments. The provision of additional recesses 42*a,b* and roller 44*a,b* simply increases the locking strength by increasing the surface areas, but this adds complexity to the device.

Figure 7:
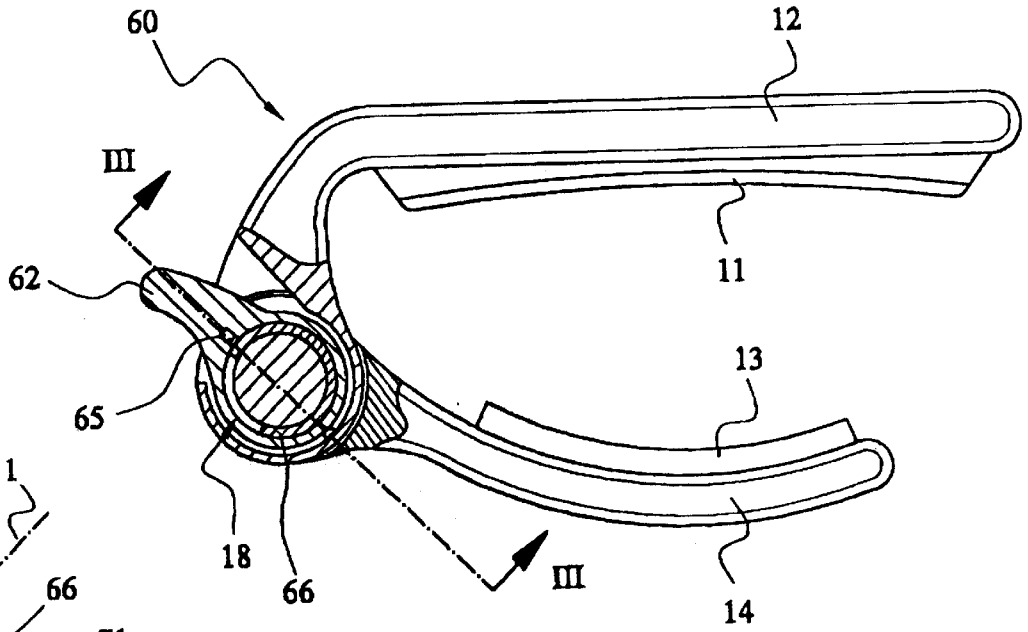
FIGS. 7 to 9 show a capo according a further embodiment of the present invention, with FIG. 7 being a part sectioned side elevation of the capo, FIG. 8 being a sectional view along plane III of the capo shown.
Figure 8:
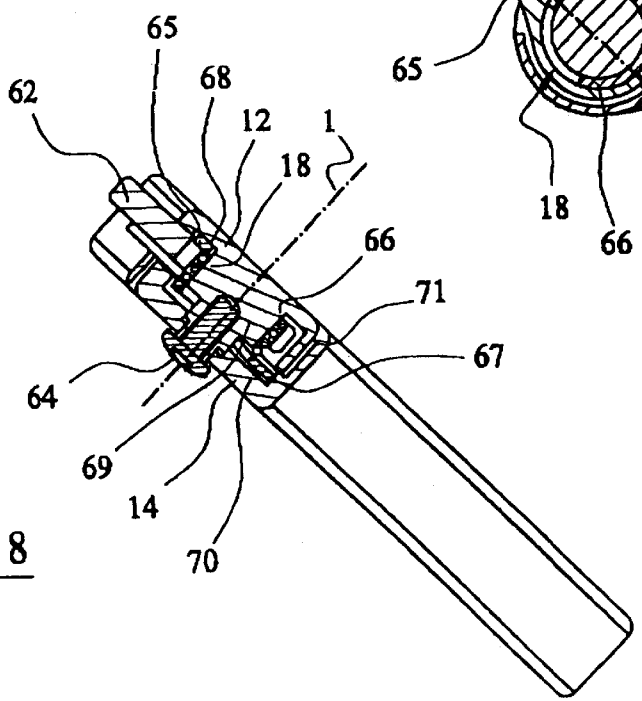
Figure 9:
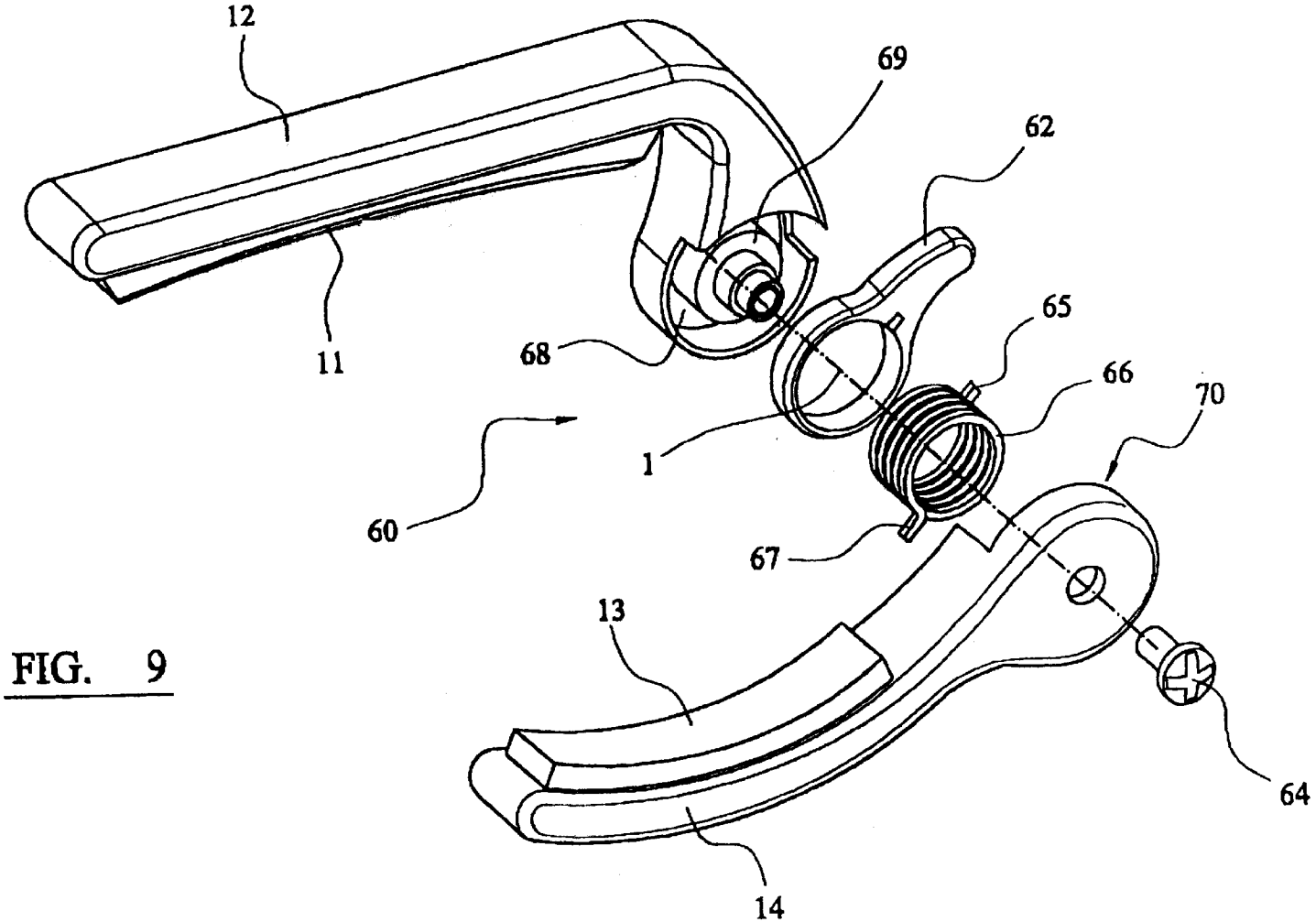

In the embodiment shown in FIGS. 7 to 9 a capo 60 includes a locking mechanism 18 comprising a wrapped spring clutch assembly which is disposed around the pivotal connection between the arms 12,14. The spring clutch assembly comprises a close wound helical spring 66 which is fitted tightly around a cylindrical pivot boss 69 at the end of the spring engaging arm 12. The spring 66 and boss 69 fit coaxially within a cylindrical socket 71 defined within one end of the clamping arm 14 with the two arms 12,14 pivoting around the axis 1 of boss 69 and socket 71. A release lever 62 is also pivotally mounted at one end around the boss 69 and spring 66 within the socket 71 coaxially with the pivot axis 1. A first end 67 of the spring 66 projects radially outwardly and is engaged within a locating recess 70 in the clamping arm 14. A second end 65 of the spring 66 similarly protects radially outwardly and is engaged within a locating recess 68 within the release lever 62. The winding of the spring 66 is arranged such that moving the spring engaging arm 12 and clamping arm 14 towards each other and closing the capo 60, for example to close the capo 60 onto the neck 2 of the instrument, opens the spring 66 coils hence allowing free pivotal movement of the arms 12,14. Movement of the arms 12,14 in the opposite direction, in other words moving the arms 12,14 away from each other and opening the capo 60, is inhibited by the spring coils closing more tightly on the boss 69 and therefore locking further movement of the arms 12,14 in this direction. Consequently once the capo 60 is closed and the setting pressure applied the arms 12,14 are restricted from moving apart and the capo 60 opening by the locking mechanism 18.

To open the capo 60 and move the arms 12,14 apart, for example, in order to remove the capo 60 from the neck 2, the release lever 62 is moved which opens the spring 66 coils such that they are no longer locked against the boss 69. The arms 12,14 can then be moved and pivoted to open the capo 60.

Although various preferable locking mechanisms 18 have been described in the various embodiments for locking the arms of the capo it will be appreciated that other known locking mechanisms 18, and in particular rotary locking mechanisms, could be used in further embodiments of the invention.

In all of the above embodiments the locking mechanism 18 generally provides a releasable non reversible means of preventing pivotal movement of the arms 12,14 in one direction, namely moving the arms 12,14 apart to open the capo. The locking mechanism 18 however permits movement in the other, closing direction. This allows the capo to be easily fitted and closed on the neck 2 of the instrument with the capo remaining in the set applied position applying the required clamping force set by the player in closing the capo. Furthermore since the locking mechanism 18 allows closing movement there is no need to actuate a separate locking means to lock the capo in position since the locking mechanism 18, as shown, can be arranged to be such that it is biassed to the locked position and in effect is automatically applied to keep the capo in the locked closed set position. In other words the capo is squeezed fitted into place with the required pressure and then is automatically held in place by the locking mechanism which prevents release of the capo but allows it to be clamped onto the neck. To remove the capo the locking mechanism is simply released, allowing the capo to open.

It will be appreciated though that other alternative locking mechanisms 18 could be used which when locked prevent pivotal movement of the arms 12,14 in the opening direction or even in both directions.

Examples of other suitable types of locking mechanisms which could be used possibly include sprag clutches or ratchet means. It will be appreciated though that there are however numerous other types of locking mechanisms that could be suitable.

With any locking mechanism 18 however there is the possibility that there may be some backlash in the mechanism 18 when locked. This should be minimised in order that the capo is secured correctly in position and applies the set clamping force. In order to remove any small backlash the resilient layers 11 and 13 on the arms may be adapted and made sufficiently resilient to accommodate any anticipated backlash.

What is claimed is:

1. A capo for use with a stringed instrument having a plurality of strings and a neck, said neck comprising a fingerboard and a back, said capo comprising:

a string engaging arm that is adapted to extend across the fingerboard above the strings and in use press against the strings;

a clamping arm that is adapted, in use, to extend across and engage the back of the neck;

a pivotal connection to pivotally interconnect the clamping arm to the string engaging arm at a position along said arms that is arranged, in use, to be adjacent said neck such that the arms can be pivoted relative to each other in order to, in use, fit and clamp the strings and neck between said arms; and a releasable locking mechanism which is operable to selectively lock and unlock the pivotal connection and the relative pivotal movement of the clamping arm and string engaging arm at least in a particular direction, the locking mechanism automatically adjusting to the thickness of the neck each time the capo is repositioned.

2. A capo as claimed in claim 1 in which the locking mechanism is operable to selectively lock and unlock the pivotal connection and relative pivotal movement of the clamping arm and string engaging arm away from each other and the neck of the instrument and so prevent opening of the capo when locked.

3. A capo as claimed in claim 1 in which the releasable locking mechanism is biased so that the locking mechanism is locked and the pivotal connection is normally locked to prevent opening of the capo.

4. A capo as claimed in claim 1 in which the pivotal connection includes a light spring which is arranged to urge the string engaging arm and clamping arm towards each other or apart.

5. A capo for use with a stringed instrument having a plurality of strings and a neck, said neck comprising a fingerboard and a back, said capo comprising:

a string engaging arm that is adapted to extend across the fingerboard above the strings and in use press against the strings;

a clamping arm that is adapted, in use, to extend across and engage the back of the neck;

a pivotal connection to pivotally interconnect the clamping arm to the string engaging arm at a position along said arms that is arranged, in use, to be adjacent said neck such that the arms can be pivoted relative to each other in order to, in use, fit and clamp the strings and neck between said arms; and a releasable locking mechanism which is operable to selectively lock and unlock the pivotal connection and the relative pivotal movement of the clamping arm and string engaging arm at least in a particular direction, wherein the locking mechanism comprises at least one wedge, and at least one co-operating tapered recess that is defined by and between a first and second oppositely facing surfaces which move relative to each other during pivotal movement about the pivotal connection of the clamping and string engaging arms, the wedge adapted to be engaged within the recess and thereby restrict relative movement of the first and second surfaces and thereby lock the pivotal connection and prevent movement of the arms in at least one direction.

6. A cap as claimed in claim 5 in which the wedge comprises a rolling element.

7. A capo as claimed in claim 6 in which the wedge comprises a spherical element.

8. A cap as claimed in claim 5 in which the first surface comprises part of the string engaging amr and the second surface comprises part of the clamping arm.

9. A capo as claimed in claim 5 in which resilient means are provided to urge the wedge into the tapered recess and into engagement with the first and second surfaces.

10. A capo as claimed in claim 5 in which there is a release lever which is adapted to urge the wedge out of the tapered recess and out of engagement with the first and second surfaces.

11. A capo for use with a stringed instrument having a plurality of strings and a neck, said neck comprising a fingerboard and a back, said capo comprising:

a string engaging arm that is adapted to extend across the fingerboard above the strings and in use press against the strings;

a clamping arm that is adapted, in use, to extend across and engage the back of the neck;

a pivotal connection to pivotally interconnect the clamping arm to the string engaging arm at a position along said arms that is arranged, in use, to be adjacent said neck such that the arms can be pivoted relative to each other in order to, in use, fit and clamp the strings and neck between said arms; and a releasable locking mechanism which is operable to selectively lock and unlock the pivotal connection and the relative pivotal movement of the clamping arm and string engaging arm at least in a particular direction, wherein the locking mechanism comprises a wrapped spring clutch which is disposed about the pivotal connection and which is arranged when applied to restrict pivotal movement about the pivotal connection.

* * * * *

UNITED STATES PATENT AND TRADEMARK OFFICE

CERTIFICATE OF CORRECTION

PATENT NO. : 6,635,813 B2
DATED : October 21, 2003
INVENTOR(S) : Nicholas John Campling It is certified that error appears in the above-identified patent and that said Letters Patent is hereby corrected as shown below:

Column 8,
Line 66, delete “cap” and insert -- capo --.

Column 9,
Line 3, delete “cap” and insert -- capo --.
Line 4, delete “amr” and insert -- arm --.

Signed and Sealed this

Twenty-fourth Day of February, 2004

JON W. DUDAS
*Acting Director of the United States Patent and Trademark Office*